US006528770B1

(12) United States Patent
Akel et al.

(10) Patent No.: US 6,528,770 B1
(45) Date of Patent: Mar. 4, 2003

(54) INDUCTION COOKING HOB WITH INDUCTION HEATERS HAVING POWER SUPPLIED BY GENERATORS

(75) Inventors: Dominique Akel, Paris (FR); Henri Schlumberger, Paris (FR)

(73) Assignee: Jaeger Regulation, Paris (FR)

( * ) Notice: Subject to any disclaimer, the term of this patent is extended or adjusted under 35 U.S.C. 154(b) by 0 days.

(21) Appl. No.: 09/544,874

(22) Filed: Apr. 7, 2000

(30) Foreign Application Priority Data

Apr. 9, 1999 (FR) ..... 99 04451
Apr. 9, 1999 (FR) ..... 99 04450

(51) Int. Cl.[7] ..... H05B 6/08; H05B 6/12

(52) U.S. Cl. ..... 219/624; 219/626; 219/662; 219/665; 363/21; 363/97

(58) Field of Search ..... 219/625, 626, 219/627, 661, 662, 665, 666, 668, 669, 667, 624; 363/21, 26, 41, 49, 97

(56) References Cited

U.S. PATENT DOCUMENTS 4,112,287 A * 9/1978 Oates et al. ..... 219/662
5,376,774 A 12/1994 McGaffigan et al. ..... 219/624
5,808,220 A 9/1998 Gaspard ..... 219/624
5,866,884 A 2/1999 Cornec et al. ..... 219/622

FOREIGN PATENT DOCUMENTS

| | | | | |
|---|---|---|---|---|
| EP | 0 283 859 | | 9/1988 | |
| EP | 0 498 735 A1 | | 8/1993 | ..... H05B/6/06 |
| EP | 0 599 519 | | 6/1994 | |
| EP | 0 498 735 B1 | | 8/1994 | ..... H05B/6/06 |
| EP | 0 498 735 B2 | | 4/1999 | ..... H05B/6/06 |
| JP | 8-213163 | * | 8/1996 | |
| JP | 9-185986 | * | 7/1997 | |

* cited by examiner

*Primary Examiner*—Philip H. Leung
(74) *Attorney, Agent, or Firm*—Drinker Biddle & Reath LLP

(57) ABSTRACT

The invention concerns an induction cooking hob with multiple inductors fed at the same frequency or multiples of a common fundamental frequency to avoid beat frequencies. Separate generators are provided for two or more heaters. A high-power heater is provided with two or more inductors. To provide maximum power, the second inductor of the high-power heater may be supplied with power switched from the generator for a different heater.

7 Claims, 4 Drawing Sheets

INDUCTION COOKING HOB WITH INDUCTION HEATERS HAVING POWER SUPPLIED BY GENERATORS

FIELD OF THE INVENTION

This invention concerns an induction cooking hob comprising induction heaters fed by generators.

Background of the Invention

Induction cooking, or more generally induction heating, uses eddy currents induced in the part to be heated by a high frequency magnetic field, the part being of an electrically conducting material. This part is, for example, a saucepan. The magnetic field is generated by an inductor supplied with a high frequency alternating current by a generator which sets the frequency and amplitude of the current as a function of the heating required. The frequency used for heating depends on a certain number of parameters and in particular the relative magnetic permeability $\mu_x$ of the receptacle and its electrical conductivity $\sigma$. Starting from the skin thickness, which one takes for example to be equal to half the thickness of the bottom of the receptacle to be heated, one then determined the angular frequency $\omega$ by using the formula:

$$\delta = \sqrt{\frac{2}{\mu_0 \cdot \mu_r \cdot \sigma \cdot \omega}}$$

from which one deduces the frequency by the formula:

$$f = \frac{\omega}{2\pi}$$

One thus obtains an optimum frequency to be used, of the order of 10 to 50 kHz.

The generator is fed from an electrical supply whose voltage is rectified and filtered. The generator supplied with this rectified voltage U is generally a resonance generator. In effect, the inductors are typically implemented by winding an electrical conductor in a spiral so that, at the operating frequency, the applied load presents this inductor with a resistance R compatible with the power $P=U^2/R$ to be transmitted to the load. These same inductors are generally isolated mechanically, electrically and thermally from the load to be heated, which entails an air gap of several millimetres between the load and the inductor. At this distance and in this range of frequencies, the impedance $Z=R+j\omega L$ of the loaded inductor is strongly reactive, which entails an inductor quality factor $Q=L\omega R>>1$. It then suffices to add one or more capacitors C to the inductor, whose inductance is L, to form a circuit resonant at a frequency:

$$f = \frac{1}{2\pi\sqrt{L \cdot C}}$$

For this reason, the generators are mainly resonance inverters. The impedance Z and in particular the inductance L of the inductor depend on the characteristics of the load. The operating frequencies for a cooking hob with several heaters are in general not identical but close to each other. This phenomenon is on the other hand accentuated by the fact that to retain soft switching modes, power adjustments are generally made by adjusting the operating frequency and therefore two heaters intended to heat identical loads at different powers will use different frequencies. It must be noted that this method of adjustment has the disadvantage of forcing the inverter to operate at frequencies far from its natural resonant frequency, which causes high losses. The best compromise is to have dual thyristor operation while working for maximum power as close as possible to the resonance which is the lowest working frequency and to increase the operating frequency to reduce this power.

These neighbouring frequencies produce beat frequencies which are transmitted to the receptacle being heated and which, owing to their small difference, are in the audible range (a few Hz to a few kHz). These beat frequencies, apart from the noise that they generate in the loads, cause difficulties in the control of independent generators.

To avoid this phenomenon which, because of its amplitude, can make using the product very inconvenient, it is necessary to maintain a good separation between the different generator—induction heater pairs, which is a major drawback for product modularity; for the same reason, it is for example impossible to heat a large saucepan on several neighbouring heaters fed by different generators.

One known solution consists of supplying neighbouring heaters cyclically for a period varying from a second, for mechanical switching devices, to ten or so milliseconds, for completely electronic solutions. In both cases, the generators must be designed with excess power capacity since power is not transmitted continuously to the heater but is alternating, with a duty cycle which varies according to the power levels demanded from each heater connected to the generator. Furthermore, this cyclic supply can be felt to be a nuisance in use of the device because of the harsh power variations in the load if the period is of the order of a second, or because of the noise related to switching if this period is of the order of a few milliseconds, which corresponds to frequencies of a few hundred hertz.

Another known solution in the field of control and power electronics is to supply the inductor at the same frequency by using generators with hard switching, for example a chopper whose power adjustment method can then be at a fixed frequency in pulse width modulation (PWM) mode. It is however not prudent to use this type of generator to supply standard inductors, in particular because of the high quality-factor of the coils at the operating frequency. In effect this leads to difficulty in making current flow in inductive coils (saw-tooth currents) and major losses when the current in these coils is cut, which requires very large over-capacity in the power generator.

SUMMARY OF THE INVENTION

This invention aims to solve these problems and sets out to develop an induction cooking hob having low and high power, and in general, an induction heating device operating at a single frequency or at multiple frequencies to avoid beat frequencies and above all allowing the use of low power generators and in particular modular generators.

To this end, the invention concerns a cooking hob of the type defined above, characterised in that the inductors that are neighbouring or constituting the same heater are fed at the same frequency or at multiple frequencies and in that it includes at least one high power heater comprising at least two inductors having a quasi identical on-load impedance returned to these inductors whatever the load put on this heater. A single controller then governs the generators which operate in resonant mode with soft switching.

Advantageously, this cooking hob includes two induction heaters equipped with inductors, at least one of the heaters (first heater) being high power with at lest two inductors having a quasi identical on-load impedance at maximum load whatever the nature, shape and position of the load placed on this heater. An inverter generator is associated with each heater and operates with soft switching, a single controller governing the two generators. A switching device is associated with the generator of the second heater and has two states:

- a normal state for which the switching device connects the generator to the inductor of the second heater,
- a power state in which the switching device connects the generator of the second heater to the second inductor of the first heater.

The resonance inverter generators, when they are synchronised in frequency, allow implementation of a high power heater with particularly economical low power generators since they are operating continuously in soft switching mode. A switching device allows the power from two or more generators to be routed to different heaters but it is quite possible to not use this switching device and to permanently connect several generators to one heater, thus increasing its power.

Thanks to the switching device, the cooking hob allows advantage to be taken of the fact that in everyday use of the equipment, it is not necessary for the user to continuously have high power available as much as with induction systems where the power is transmitted directly to the load. The efficiency is particularly high. These power levels are useful during special, short duration preparation sessions (boiling water, heating large quantities of liquid, getting a large grill up to temperature). In continuous use, the power levels needed to maintain cooking (keeping on the boil, simmering) are most often low and can be provided by a single generator.

In this cooking hob, the two heaters can each be formed by two or more inductors having, for each heater, a quasi identical on-load impedance on its inductors; since each heater is associated with a generator, switching devices allow generators of other heaters to be connected to the inductors of the same heater to thus have available high power supplied by several low-power generators and not by a single high-power generator. This allows in particular modular, large-scale fabrication of low-power resonance inverter generators which are moreover usable tin numerous other fields.

The market for power electronics and frequency converters is booming and certain applications are or will shortly be produced by the million for use as frequency converters for control of motors or power supplies intended for microwave oven magnetrons for example. It is thus economically very interesting to be able to benefit from this scale effect, either on the power components or on the control micorprocessors, or on the generators themselves. Major production runs are carried out on low-power converters. The implementation method described allows the use of generators with various power capacities by coupling these low-power converters to heaters in which the power will be equal to the sum of the power capacities of the converters connected to the heater.

The frequency of the different generators connected to a heater must therefore be identical or a multiple of one and the same frequency. The phase of the different generators is in general zero (generators in phase) but it can be advantageous to run the generators in phase opposition in order to accumulate the magnetic flux from neighbouring inductors, which also has the effect of reducing the magnetic field in the immediate vicinity of the inductors. In the case of inductors combined to form the same heater and each having a quasi identical impedance on load, if the same number of combined inductors is in phase and in opposition, then the heater will generate a magnetic field and therefor quasi zero power. By varying the respective phases of the generators connected to the heater from 180° to 0°, it is very easy to achieve variance in the heater power from 0 to the total power of all the generators connected to the heater when they are all in phase. This is particularly interesting since power adjustment can then occur at a fixed frequency which can be chosen to be sufficiently close to the natural resonance of the converter so as to minimise losses in the latter. Power adjustment is much finer since it is difficult to increase the generator operating frequency indefinitely in relation to its natural resonance to reduce the power and, below a certain power, chopping techniques have to be employed to reach sufficiently low power levels. Finally, to cancel out the field of an inductor by controlling the converters connected to it can also be of particular interest with the aim of minimising the leakage magnetic field in the case of inductors not coupled or badly coupled to loads.

According to other advantageous characteristics:

the hob has several low-power generators connected to one or more inductors;

the single controller has a sensor detecting the presence of a load on the inductor to authorise its supply by one or more generators;

the single controller controls the neighbouring inductors so that their electromagnetic fields produce a cumulative flux between the inductors and under the load;

the single controller controls the inductors of the same heater by adjusting the relative phase of the currents supplied by the generators associated with these inductors within a phase shift range between 0° and 180°, in order to adjust the heater power or limit its radiation;

the hob is formed from mass-produced, low-power generators with devices allowing them to be associated and form high-power heaters;

the induction coils are capable of withstanding high temperatures and are arranged as closely as possible to the load while being electrically isolated from it so that the resistance of the coil on load is high considering its inductance;

the generator includes a decoupling capacitor which is split so as to create a quasi fixed capacitive voltage divider;

the switching device comprises a changeover switch to connect the generator of the second heater to the second inductor of the first heater;

the switching device includes a break switch between the junction point of the inductances of the first heater and the capacitors of the resonant circuit of the first inductance of the first heater to close (open) the resonant circuit of the first inductor of the first heater and a changeover switch to connect the inductor of the second heater to its generator or to connect the second generator to the second inductor of the first heater, in series with the first inductor of this first heater and in series with a common capacitor.

BRIEF DESCRIPTION OF THE DRAWINGS

This invention will be described below in a more detailed manner with the aid of appended diagrams in which.

DETAILED DESCRIPTION OF THE DRAWINGS

Figure 1:
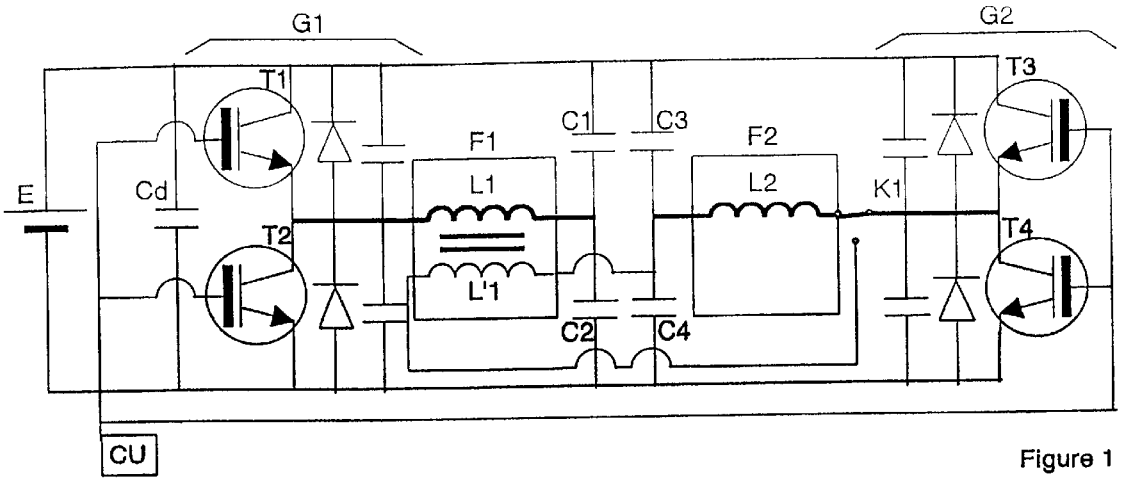
FIG. 1 is a diagram of the first implementation method for a cooking hob with two heaters according to the invention, in normal and independent operation of two heaters.

According to FIG. 1, the invention concerns an induction cooking hob not shown, with two heaters F1, F2. One of the heaters, F1, or the first heater is designed to supply a high power while the other heater F2 is only designed to supply medium power.

High-power heater F1 has two inductors L1, L'1 having a quasi identical on-load impedance on these inductors. This identical on-load impedance is obtained by the design of the inductors, not described here. This on-load impedance is the same whatever the nature, shape and position of the load, that is to say utensil to be heated, placed on heater F1 equipped with its two inductors.

These heaters are supplied with high-frequency current, as generally know, from a DC source shown diagrammatically by E. This source in fact represents a rectifier and filter assembly connected to the mains supply and providing on its output a rectified voltage with a DC component.

This DC supply feeds the two resonance inverter generators G1, G2. Generator G1 is associated with heater F1 and generator G2 with heater F2. These generators operate with soft switching. They each comprise two transistors T1, T2 or T3, T4, provided in the usual manner with unreferenced diodes and capacitors. These generators each supply an oscillator circuit formed from inductance and capacitance. The load resistances "seen" by the inductors are not shown and are implicitly included in the Li terms, in series with the resistances.

Generator G1 oscillator circuit is formed by the inductance L1 of inductor $I_1$ of heater F1 and charge capacitors C1, C2.

Generator G2 oscillator circuit is formed by the inductance L2 of inductor $I_2$ of heater F2 and charge capacitors C3, Cr.

Transistors T1, T2 and T3, T4 of the two generators G2, G1 are connected to a single controller CU which operates them independently or in synchronism.

Power heater F1 comprises two inductors L1, L'1 combined so that their on-load impedances are identical; their coupling is shown in FIG. 1.

Power supply E is decoupled by a decoupling capacitor Cd.

Figure 1A:
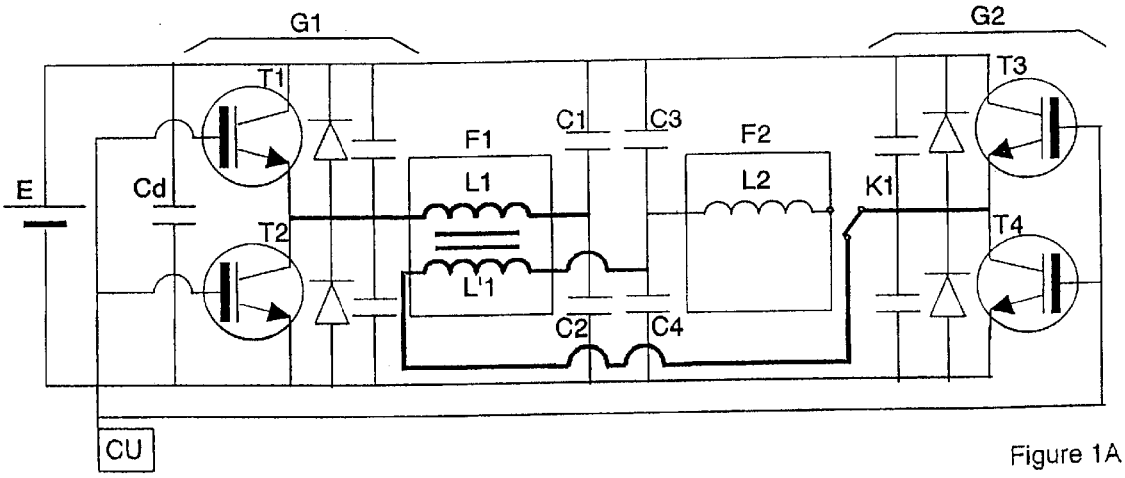
FIG. 1A shows the diagram of FIG. 1, in power operating mode on the heater composed of combined inductors having an identical on-load impedance.

The circuit also has a two-state switching device, a normal and a power state. In the example, the switching device is formed by a two-position changeover switch K1 associated with generator G2 of the second heater F2. This changeover switch K1 can go into the normal state (FIG. 1) in which it closes the generator G2 circuit as the latter is then connected to inductance L2 of inductor $I_2$ and allows heater F2 to be supplied. This changeover switch K1 can also change to a second state or power state (FIG. 1A) in which it ensures connection of inductance L1' of the first heater F1, so that in this position the inductance L1 is fed by generator G1 and inductance L'1 by generator G2, inductance L2 of the second heater F2 being disconnected. As it is assumed that in this second position the impedances and therefore the inductances L1 and L'1 are identical on load, the two inductors $I_1$, L'1 of heater F1 will be able to be controlled in synchronism and work in a synchronous manner in soft switching mode.

The two generators supply power variable between zero and an equal or different maximum power P for the two in the normal position, when changeover switch K1 ensures connection of inductor $I_2$, heaters F1 and F2 can both receive a power going as far as maximum power P from each of the generators G1, G2 to which they are re independently connected. The two generators can also be designed for different power capacities.

In the second state, namely power, heater F1 receives double power, being able to go up to the maximum power 2P.

It should be noted that since inductances L1, L1' are coupled by their arrangement in their heater F1 inductor, it is necessary for the current flowing in them to be synchronous. This is assured by the single controller Cu for the two generators G1, G2 and by the fact that the load applied to them is the same.

This circuit in FIG. 1 can be generalised to a number (n) of inverters allowing transmission to a heater of a power going from 0 to n.P. As already mentioned above, this allows implementation of a high-power heater with low-power generators. By way of example, for certain professional uses, heaters with a power of the order of 7 to 8 kW are necessary. One can thus implement a heater with a power of 7.2 kW by using four generators each having a power of 1.8 kW connected to a heater which has four linked inductors. This circuit is also applicable to combinations of linked inductors, the latter then having to have an identical or multiple on-load impedance so that the operating frequencies of the different generators are identical or multiple. In the case of (n) inverters, the latter can also advantageously have (n') switching devices so that in the power position, a heater can receive power from (n) generators or several heaters can receive a power higher than the power from a single generator and that in the normal position, the (n) generators each feed a heater on the induction cooking hob, certain heaters being able to operate continuously with several generators.

The diagram in FIG. 1 can also be generalised to be completely symmetrical, that is to say to have two heaters each with two inductors so as to allow the independent supply to each of the heaters with its generator and the use of only one of the two inductors or to connect the two generators to the two inductors of the same heater. This can be necessary in certain configurations of heating surfaces to have powerful heaters at the front of the heating plate and not solely at the back as is the case traditionally.

As cooking hobs have four heaters in general, it is in effect sufficient to propose two potentially very powerful heaters. Temporary stoppage of the front heater during use of the rear heater on high power is not harmful inasmuch as the power of each generator is relatively high for example (1400 to 1800 W maximum) and there are two additional heaters still available on the cooking hob. Finally, this is particularly interesting since the surfaces of the heaters are different and correspond better to normal use when one uses saucepans of different sizes, large one on large heaters which can be very powerful and small ones on small heaters whose power remains sufficient in relation to the size of the load to be heated.

In the circuit shown in FIG. 1, it is necessary for the loads to be very similar. This imposes obligations not only on the design of inductors $I_1$, $I_{1'}$ but also on the tolerances of the resonance capacitors.

Figure 2:
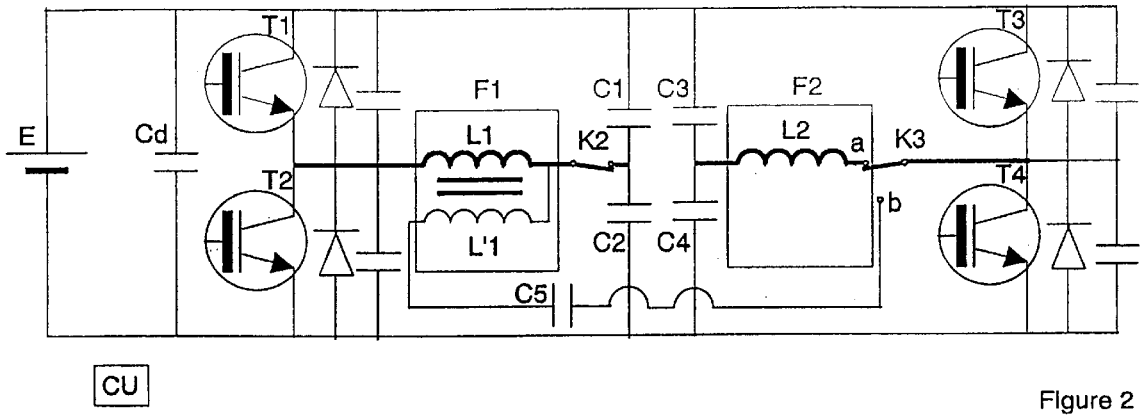
FIG. 2 shows a diagram of a first variant of the implementation of a two-heater cooking hob, in normal and independent operation of the two heaters.

FIG. 2 shows a variant of implementation of the cooking hob according to the invention, allowing the constraints imposed on the circuit components to be avoided.

Elements of this circuit that are identical to those of the FIG. 2 circuit have the same references.

This circuit is distinguished by an additional charge capacitor C5 and a switching device having a changeover switch K3 in addition to break switch K2.

The two inductors $I_{1'}$ and $I_{2'}$ are overlapping the same way and a double line schematically shows their electromagnetic coupling in heater F1.

Figure 2A:
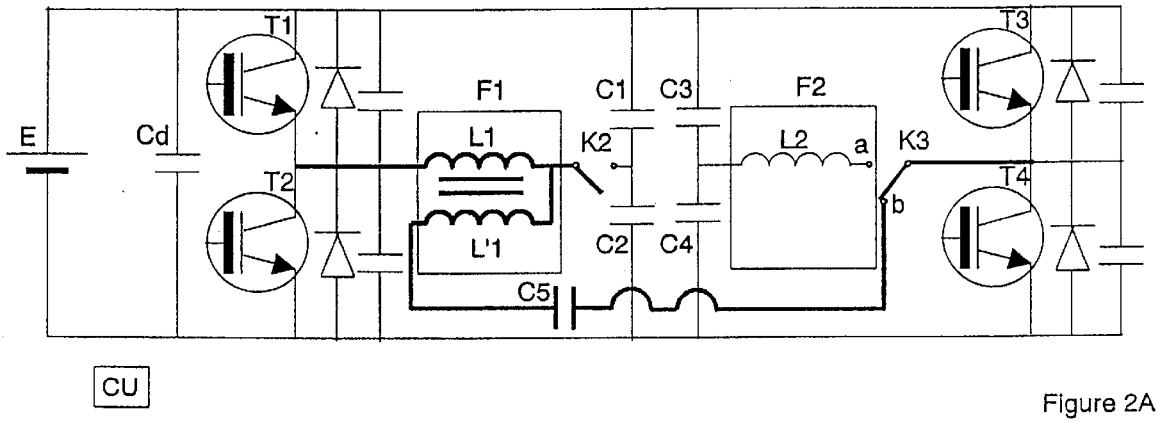
FIG. 2A shows a diagram of the cooking hob of FIG. 2 in power operating mode.

Break switch K2 can go into a closure position (FIG. 2) and an opening position (FIG. 2A). Changeover switch K3 can go into a position 'a' (FIG. 2) or a position 'b' (FIG. 2A).

Thus, depending on the position of break switch K2 and changeover switch K3, one can make the two heaters operate separately by supplying each from its generator G1, G2 or make heater F1 operate at power by supplying it from the two generators G1, G2. In the first case, the resonant circuits for heaters F1 comprise inductance Liand charge capacitors C1, C2 and for heater F2 comprise inductance L2 and charge capacitors C3, C4. When the two generators G1, G2 are connected to the two inductances $I_1$, $I_{1'}$ of heater F1, the resonant circuit is formed by inductance L1, L1' in series with charge capacitor C5.

FIG. 2 shows, for the in full line position of the switching elements (break switch K2, changeover switch K3), the supply of inductor $I_1$ of heater F1 since the resonant circuit L1, C1, C2 is connected to the power supply and the operation of the heater F2 since the resonant circuit L2, C3, C4 is connected to the power supply.

In this operating mode, the controls for the two inverters are independent as a function of the control orders and their respective loads; as for the diagram in FIG. 1, the operating frequencies are completely asynchronous, which necessitates a sufficient spacing between the two separate heaters.

FIG. 2A shows the position of the switching elements K2, K3 for operation of heater F1 on power, heater F2 being disconnected.

Break switch K2 and changeover switch K3 are in the following positions: break switch K2 is open and changeover switch K3 is in position b, putting in series the inductors (inductances L1 and L'1) with capacitor C5 and breaking the resonant circuit of inductor $I_2$ of heater F2. The currents flowing in inductances L1, L'I are then completely identical and are so whatever the tolerances on the components, notably the resonance capacitors, as these inductances are fed in series.

The switching state of the two operating modes of the circuit in FIG. 2 is summarised as follows:

Normal state

Normal and independent operation of heaters F1 and F2:

*L1* and *L2*: active (FIG. 2)

*L'1* = 0 *K2* = 1

*K3* = *a*

Power State

Operation of heater F1 at high power:

*L1* and *L'1*: active (FIG. 2a)

*L2* = 0 *K2* = 0

*K3* = *b*

Figure 3:
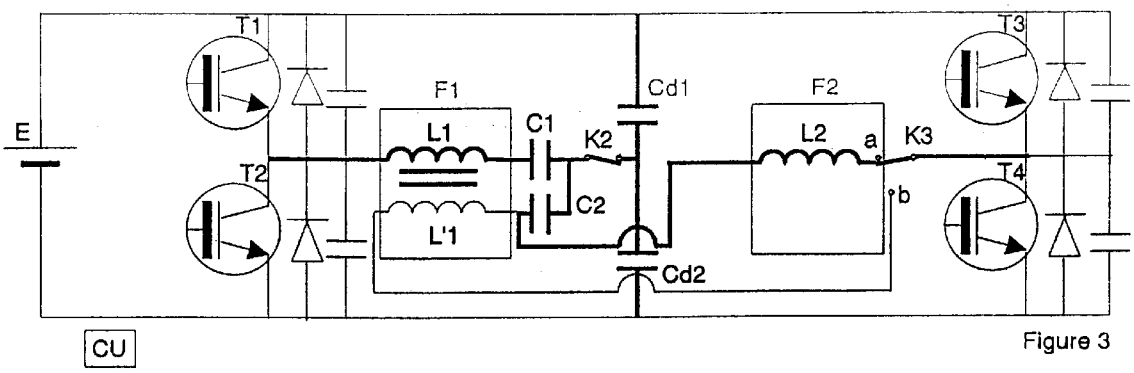
FIG. 3 shows a diagram of a second variant of the implementation of a two-heater cooking hob according to the invention, in normal operating mode.

FIG. 3 shows a simplification of the circuit in FIG. 2, minimising the number of capacitors used.

In this variant, the same references as above will be used to designate the same elements.

The modification is the transformation of decoupling capacitor Cd, which is separated into two capacitors C21, Cd2, forming a capacitive divider giving a quasi fixed voltage. For this, it is necessary to respect the following conditions between the capacitances CdL, Cd2, C1 and C2:

$$Cd1+Cd2>>C1$$

$$Cd1+Cd2>>C2$$

To separate the decoupling capacitor into two capacitors is particularly interesting to reduce the overall thickness of the generator.

As previously, this cooking hob can operate in normal mode with two independent heaters and in a mode with a single heater at high power.

Figure 3A:
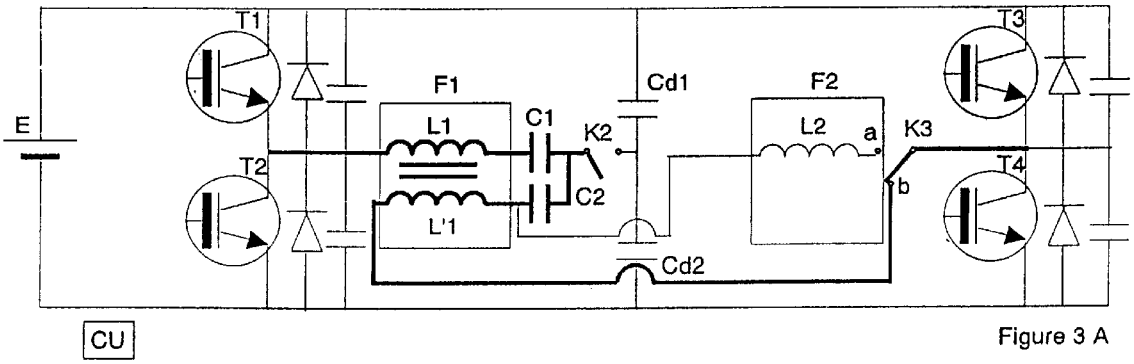
FIG. 3A shows a diagram of the cooking hob of FIG. 3 in power operating mode.

These two modes are shown respectively for the position of break switch K2 and changeover switch K3 comprising the switching device in FIG. 3 and FIG. 3A.

Capacitor C5 of the second variant (FIG. 2) does not exist in this case.

The two modes of operation are as follows:

Normal operating state (normal state) with independent heaters F1, F2:

Break switch K2 is closed and changeover switch K3 is in position a. Inductances L1, L2 of the inductors of the two heaters F1, F2 are connected separately, each to its generator G1, G2.

Inductance L'1 is not connected.

The oscillator circuit of inductor $I_1$ put into operation alone for heater F1, is formed by inductance L1 and capacitors C1, Cd1, Cd2.

The oscillator circuit of generator G2 is formed by inductance L2 and capacitors Cd1, Cd2.

This made of operation is represented as follows:

*L1* and *L2*: active (FIG. 3)

*L'1* = 0 *K2* = 1

*K3* = *a*

The second operating state corresponds to operation of F1 alone at high power, heater F2 having no supply. Break switch K2 is then open and changeover switch K3 is in position b.

In this case, inductances L1, L1' of inductors $I_1$, $I_1$' of heater F1 are connected in series with capacitors C1, C2 and constitute the load on the H bridge formed by the two converter elements of G1, G2.

This mode of operation is represented as follows:

$L1$ and $L1'$: active (FIG. 3A)

$L2 = 0 \quad K2 = 0$ $K3 = b$

This circuit offers the advantage of appreciably reducing the overall volume of the capacitors for operation quasi identical to the preceding operation.

In general, circuits 2 and 3 do not make it obligatory to use particular inductors with an identical on-load impedence. It is then possible to extend the arrangement configurations of the inductors by implementing heaters of various shapes and dimensions by associating elementary inductors. One can for example implement oblong heaters intended for fish hot-plates, these oblong heaters being formed for example from two heaters placed side by side. The operating frequency is then unique to the structures used.

This does however impose an identical current in these heaters and therefore the impossibility of adjusting the power of neighbouring heaters separately. It is however possible, by keeping a single frequency or multiple frequencies, to adjust the power of neighbouring heaters separately and for this it is necessary to use particular structures, giving rise to the notion of a master generator and slave generators whose operation will be linked to the operation of the master.

Figure 4:
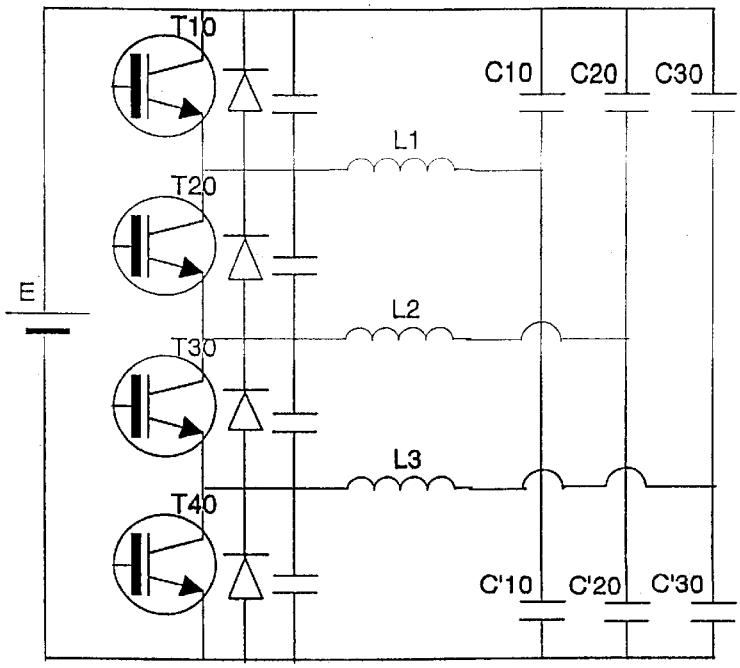
FIG. 4 shows a method for implementation of a cooking hob with three heaters having one impedance on whatever load.

FIG. 4 shows an implementation to supply, for example, three inductors I1, I2, I3 whose inductances L1, L2, L3 have some value or other.

This circuit can be used to feed 2 to n inductors; for 1 inductor, one thinks of a standard series resonance half-bridge.

The oscillator circuits are formed each time by inductances L1, L2, L3 and the associated capacitors (C10, C'10), (C20, C'20), (C30, C'30). This circuit includes several resonance inverters with a common basic frequency. One can think of different generators.

Thus, when transistors T30, T40 are cut off, inductance L1 is supplied via the half-bridge (T10, T20).

When transistors T10 and T20 are cut off, transistors T30, T40 supply inductance L3. Finally, when transistors T10, T40 are cut off, inductance L2 is supplied via the half-bridge (T20, T30). One can also supply them simultaneously by controlling a master inductor and controlling the other inductors by the same voltage but with an adjustable duty cycle according to the technique of pulse-width modulation (PWM). In this case, one adapts the capacitance of the resonance capacitors so that all the break switches work according to a dual thyristor switching mode. In this case, one also has soft switching from a single frequency for nevertheless different loads associated with each of the inductors I1, I2, I3 which can be used simultaneously and placed in proximity to one another without the risk of generating beat frequencies while authorising different power levels on neighbouring inductors supplied by different inverters, the power settings being adjusted as a function of the pulse width (PWM). It will be noted that without employing this device, PWM chopper mode would lead to designing considerable over-capacity into the generator owing to the very inductive nature of the inductors. This very inductive character can be alleviated by getting the inductor as close as possible to its load, indeed by replacing the glass of the ceramic hob by a more resistive material of less thickness, electrically isolating the inductor from its load.

Figure 5:
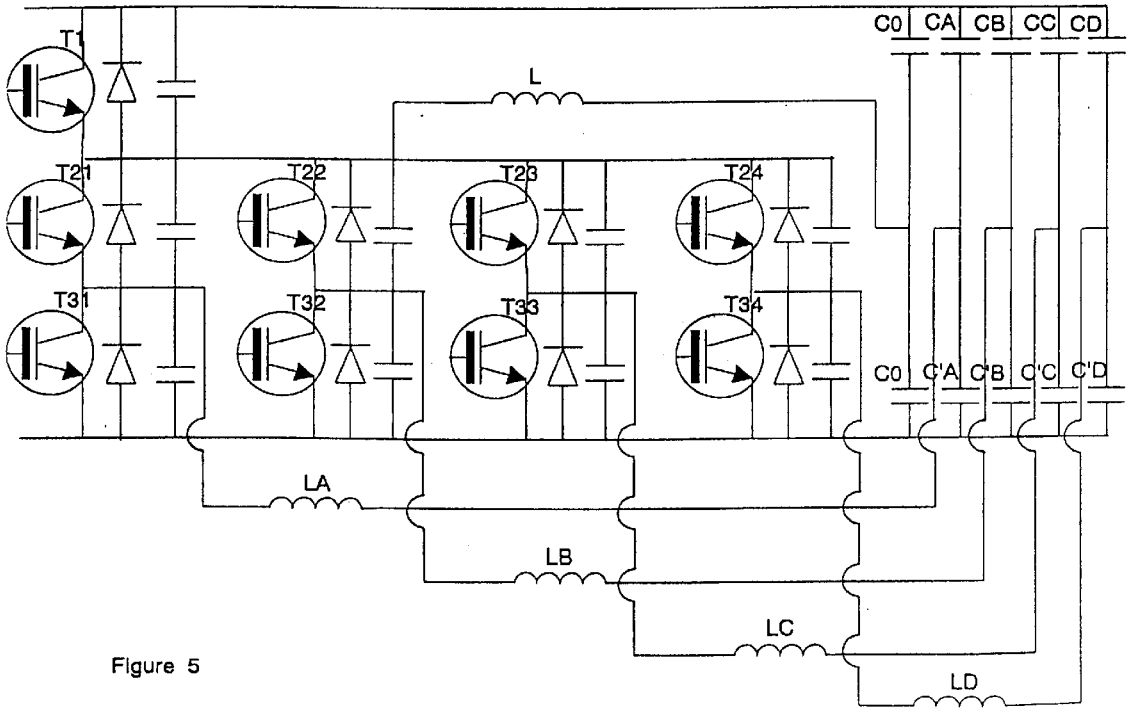
FIG. 5 shows a generalization of the cooking hob of FIG. 4 able to work with several inductors having one impedance on any load.

FIG. 5 shows a variant of the circuit in FIG. 4 for a larger number of inductors to be controlled according to the same principle, with a master inductor and slave inductors, working in zero-crossing voltage switching operation (ZVS switching) for all generators supplying the slave inductors.

The circuit comprises a master circuit L, (C0, C'0) in the upper part and slave circuits formed by inductances LA, LB, LC, LD and associated capacitors (CA, C'A). (CB, C'B), (CC, C'C), (CD, C'D). Each oscillator circuit thus formed is controlled by changeover switches (T2i, T3i). (T21, T22, T23, T24, . . . , T31, T32, T33, T34).

Break switch T1 is controlled by a standard voltage and each of the arms T2i, T3i is controlled according to a varialbe duty cycle inside this voltage, separately adjustable for each generator.

Switching conditions in ZVS mode are as follows:

at the time a break switch T2i opens, the current Ti must be greater than 0, to be able to open break switches T3i (which must be opened simultaneously), it is necessary that $-I_o > I1 + I2 + \ldots + Ii-1$.

In parallel, one can generate the current $I_p$ in a fixed and controlled manner by supplying not an inductor but, for example, a pure inductance of fixed value; the peak values of the current will be fixed and calculated to allow ZVS switching of all the generators. This modular structure is well adapted to controlling a system of inductors with a large number of winding elements. The power of each generator is then low.

This structure according to the invention therefore allows use, in the same cooking hob, of separate inductors and for them to be sufficiently close together for them to orm a large cooking surface able to heat either a single large container at high power, or different containers at power levels which can be different. Since the "slave" converters are low power, it is possible to use very economical components as indicated above, since they are used moreover in large-scale mass production.

What is claimed is:

1. An induction cooking hob comprising:

a first induction heater having power supplied by a first generator;

a second induction heater having power supplied by a second generator;

wherein the first heater has at least two inductors and the second heater has at least one inductor, and the inductors of the first and second heaters are supplied at the same frequency or at multiples of one frequency;

wherein the first heater is higher power than the second heater and said at least two inductors of said first heater have an input impedance substantially independent of a load put on the first heater; and wherein the generators comprise switches controlled by a single controller and the generators operate in resonant mode.

2. A cooking hob according to claim 1, wherein the cooking hob includes a switching device having two states:

(1) a normal state for which the switching device connects the second generator to at least one inductor of the second heater; and (2) a power state for which, while the first generator supplies a first inductor of the first heater, the switching device connects the second generator to a second inductor of the first heater so as to increase the power of the first heater, the controller controlling the first and second generators to supply said first and second inductors at the same frequency or frequencies that are multiples of one frequency.

3. A cooking hob according to claim 2, wherein the switching device includes:

a junction point connecting said at least two inductors of the first heater;

capacitors of a resonant circuit of a first inductor of the first heater;

a break switch between said junction point and said capacitors to close (open) the resonant circuit of the first inductor of the first heater; and a changeover switch to connect the inductor of the second heater to the second generator or to connect the second generator to a second inductor of the first heater, in series with the first inductor of the first heater and in series with a common capacitor.

4. A cooking hob according to claim 1, wherein the single controller has a sensor for detecting the presence of a load on an inductor and is arranged to cause one or more of the generators to supply that inductor with power only when the sensor detects the presence of a load.

5. A cooking hob according to claim 1, wherein the single controller controls two or more inductors heating a single load so that their electromagnetic fields produce a cumulative flux between those two or more inductors.

6. A cooking hob according to claim 1, wherein the single controller controls the inductors of the first induction heater by adjusting the relative phase of the currents supplied by the generators associated with these inductors within a phase shift range between 0° and 180° in order to adjust heater power or limit radiation from the heater.

7. A cooking hob according to claim 1, wherein the first generator supplies a first inductor of the first heater, and the cooking hob comprises a changeover switch to connect said second generator to a second inductor of the first heater.

* * * * *